US006607024B2

(12) United States Patent
Brucher et al.

(10) Patent No.: US 6,607,024 B2
(45) Date of Patent: Aug. 19, 2003

(54) GAS ENTRY CONE

(76) Inventors: Peter Brucher, Thalestr. 4, Oranienburg (DE), 16515; Carsten Birk, Residenzstr. 7, Berlin (DE), 13409

( * ) Notice: Subject to any disclaimer, the term of this patent is extended or adjusted under 35 U.S.C. 154(b) by 74 days.

(21) Appl. No.: 09/992,724

(22) Filed: Nov. 16, 2001

(65) Prior Publication Data

US 2002/0096315 A1 Jul. 25, 2002

(30) Foreign Application Priority Data

Dec. 21, 2000 (DE) ..... 100 64 389

(51) Int. Cl.[7] ..... F28F 13/14
(52) U.S. Cl. ..... 165/134.1; 165/154
(58) Field of Search ..... 165/134.1, 154; 122/DIG. 13

(56) References Cited

U.S. PATENT DOCUMENTS 3,374,832 A * 3/1968 Tucker ..... 165/134.1
4,457,364 A * 7/1984 DiNicolantonio et al. ..... 165/134.1
4,614,229 A * 9/1986 Oldweiler ..... 165/115
5,464,057 A * 11/1995 Albano et al. ..... 165/173
5,595,242 A * 1/1997 Jekerle et al. ..... 165/154
5,816,322 A * 10/1998 Albano et al. ..... 165/173

FOREIGN PATENT DOCUMENTS

GB 1129588 A * 10/1968 ..... F28F/9/02
JP 55-63395 A * 5/1980 ..... F28F/9/00

* cited by examiner

*Primary Examiner*—Allen Flanigan
(74) *Attorney, Agent, or Firm*—Thomas S. Baker, Jr.

(57) ABSTRACT

In a double-pipe heat exchanger for cooling cracked gas, the double pipes are inserted in rows into oval pipe collectors (3), and several oval pipe collectors (3), arranged parallel to each other, are joined into a tight floor (5) which forms the upper cap of the gas entry cone. The floor (5) has a cylindrical flange collar (6) fastened to it, which is connected to a ring flange (9) attached to the gas entry cone. The gas entry cone is provided on the inside with a lining (11) whose inner contour (13) forms a central interior space (12) which widens in the direction of the floor (5). This lining (11) of the gas entry cone continues into the flange collar (6), and the inner contour (13) of the lining (11) continues all the way to the floor (5).

4 Claims, 1 Drawing Sheet

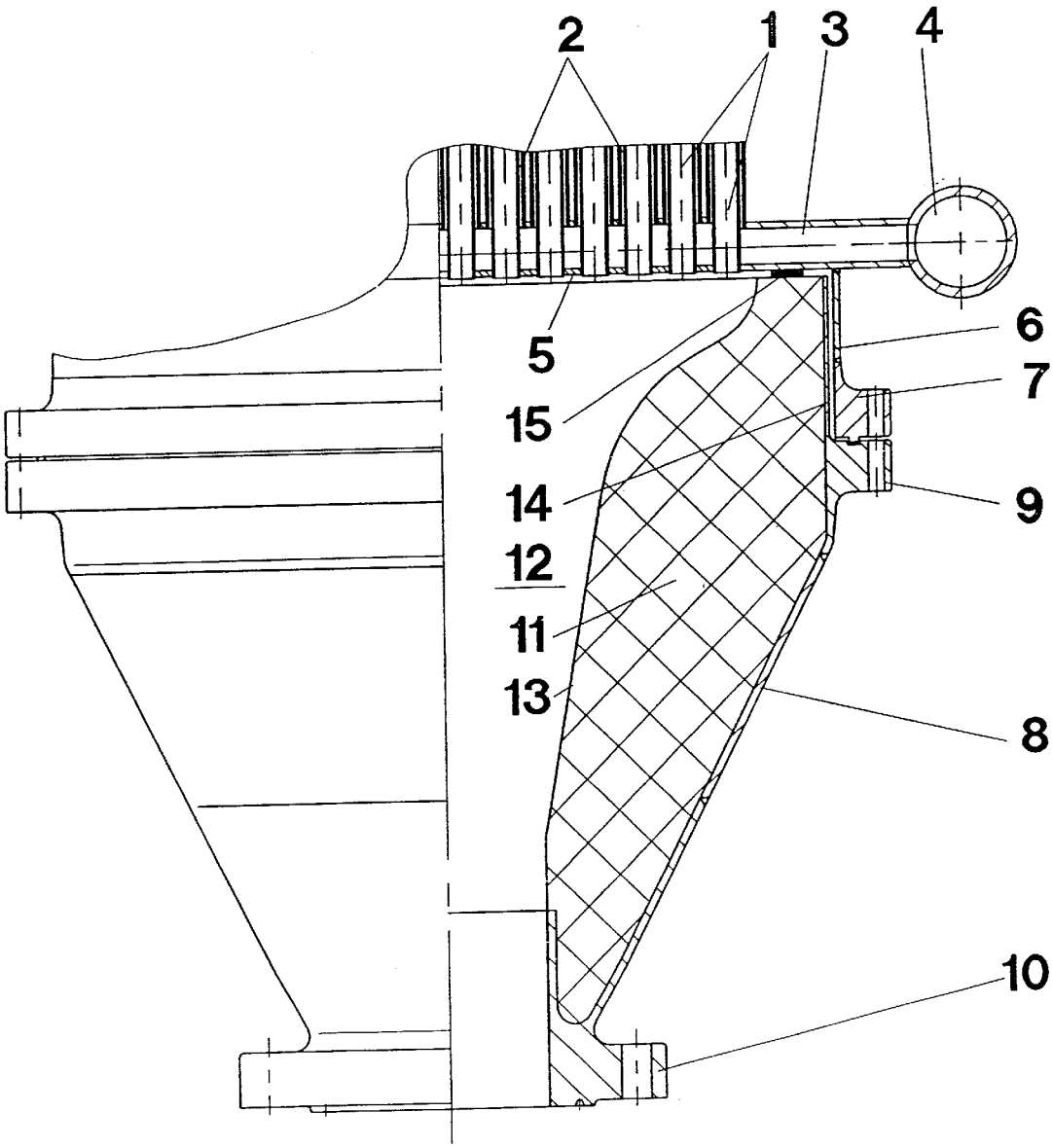
2
1
3
4
5
6
7
15
14
9
12
11
13
8
10

GAS ENTRY CONE

The invention relates to a gas entry cone for a double-pipe heat exchanger for the cooling of cracked gas, according to the characterizing part of claim 1.

The floor of the double-pipe heat exchanger, made up of oval pipe collectors, requires a flange collar that is welded to the end of the floor in order to be able to fasten the gas entry cone to the double-pipe heat exchanger by means of a flange connection. This design results in a cylindrical lining up to the flange split line, which lining increases the hood volume of the gas entry cone, determined by the interior space, in an undesirable manner.

The goal of this invention is to configure the generic gas entry cone in such a way as to make it possible to reduce the hood volume.

According to the invention, this goal is achieved in the case of a generic gas entry cone by the characterizing portion of claim 1. Advantageous embodiments of the invention are the subject of the dependent claims.

According to the invention, the lining of the gas entry cone is continued uninterrupted, i.e. without shoulder or split line, into the flange collar that is fastened to the floor, resulting in a one-piece lining. This makes it possible to place the lining in the flange collar, without split line and without cylindrical component, allowing the inner contour of the lining to begin at the floor, thereby significantly reducing the hood volume.

One example of an embodiment of the invention is shown in the drawing and described in more detail below. The drawing shows a longitudinal section of a gas entry cone.

The gas entry cone shown here is used for the distribution of hot cracked gas from a cracking furnace to the pipes of a double-pipe heat exchanger for cooling this cracked gas. The double-pipe heat exchanger, only partially shown, is made up of double pipes, arranged in several rows, each double pipe comprising interior pipe 1 and exterior pipe 2 surrounding interior pipe 1 at a certain interval.

Interior pipes 1 and exterior pipes 2 of several double pipes are inserted into an oval pipe collector 3 in such a way that interior pipe 1 penetrates oval pipe collector 3 and is tightly connected to the downward-pointing wall of oval pipe collector 3, while exterior pipe 2 is tightly connected to the upward-pointing wall of oval pipe collector 3. Oval pipe collectors 3 are connected to collector 4 for admitting water under pressure. The admitted water enters an annular gap between interior pipe 1 and exterior pipe 2 and subsequently flows upward along interior pipe 1.

Several oval pipe collectors 3 are arranged parallel to each other and tightly welded together to form floor 5. The lower end of floor 5 is connected to cylindrical flange collar 6, which ends in ring flange 7. This flange collar 6 is connected to floor 5, consisting of oval pipe collectors 3, in such a way that the discharge orifices of all interior pipes 1 lie within a plane enclosed by flange collar 6.

The gas entry cone is connected to the double-pipe heat exchanger via flange collar 6. The gas entry cone is delimited on top by floor 5 and has an exterior casing 8 which widens conically in the direction of the double-pipe heat exchanger. Exterior casing 8 is provided at both ends with a ring flange 9, 10. Lower ring flange 10 serves to connect the gas entry cone to the cracking furnace (not shown), while upper ring flange 9, together with ring flange 7 of flange collar 6, form the flange connection for fastening the gas entry cone to the double-pipe heat exchanger.

Exterior casing 8 of the gas entry cone is equipped on the inside with a heat-resistant, insulating lining 11. The lining leaves open an interior space 12, through which the cracked gas is distributed to interior pipes 1. Lining 11 continues upward from the gas entry cone through flange collar 6 all the way to floor 5, without split line or shoulder. There is a seal 15 between the upper edge of lining 11 and floor 5.

Inner contour 13 of lining 11 widens in the direction of floor 5 and terminates there. This makes it possible to configure inner contour 13 so that the hood volume—the open interior space 12 within lining 11 of the gas entry cone—can be kept as small as possible.

Lining 11, reaching into flange collar 6, does not have to be supported on the outside, although a support is recommended. Such a support can be in the form of a cylindrical shell 14, for instance, that is welded to exterior casing 8 of the gas entry cone and forms the outside boundary of lining 11.

After disengaging the flange connection between ring flange 7 of flange collar 6 and upper ring flange 9 of the gas entry cone, exterior casing 8 can be removed, allowing the gas entry cone to be detached from the double-pipe heat exchanger as one unit along with the entire lining 11.

What is claimed is:

1. Gas entry cone for a double-pipe heat exchanger for the cooling of cracked gas, where the double pipes are inserted in rows into an oval pipe collector (3), and several oval pipe collectors (3), arranged parallel to each other, are joined into a tight floor (5) forming the upper cap of the gas entry cone, the floor (5) having a cylindrical flange collar (6) fastened to it, which, in turn, is connected to a ring flange (9) attached to the gas entry cone, and the gas entry cone having a lining (11) on the inside whose inner contour (13) forms a central interior space (12) that widens in the direction of the floor (5), characterized in that the lining (11) of the gas entry cone is a unitary structure that extends above said gas entry cone ring flange (9) and continues into the flange collar (6) of said floor (5) and the inner contour (13) of the lining (11) continues to said floor (5).

2. Gas entry cone for a double-pipe heat exchanger for the cooling of cracked gas, where the double pipes are inserted in rows into an oval pipe collector (3), and several oval pipe collectors (3), arranged parallel to each other, are joined into a tight floor (5) forming the upper cap of the gas entry cone, the floor (5) having a cylindrical flange collar (6) fastened to it, which, in turn, is connected to a ring flange (9) attached to the gas entry cone, and the gas entry cone having a lining (11) on the inside whose inner contour (13) forms a central interior space (12) that widens in the direction of the floor (5), characterized in that the lining (11) of the gas entry cone continues into the flange collar (6), that the inner contour (13) of the lining (11) continues all the way to the floor (5), and that said gas entry cone has a cylindrical shell (14) fastened to it, which extends into the flange collar (6) and delimits the lining (11) from the outside.

3. Gas entry cone according to claim 2, characterized in that the gas entry cone along with the entire lining are detachable from the double-pipe heat exchanger in one piece.

4. Gas entry cone for a double-pipe heat exchanger for the cooling of cracked gas, where the double pipes are inserted in rows into an oval pipe collector (3), and several oval pipe collectors (3), arranged parallel to each other, are joined into a tight floor (5) forming the upper cap of the gas entry cone, the floor (5) having a cylindrical flange collar (6) fastened to it, which, in turn, is connected to a ring flange (9) attached to the gas entry cone, and the gas entry cone having a lining (11) on the inside whose inner contour (13) forms a central interior space (12) that widens in the direction of the floor (5), characterized in that the lining (11) of the gas entry cone continues into the flange collar (6), that the inner contour (13) of the lining (11) continues all the way to the floor (5), and that said gas entry coil along with the entire lining are detachable from the double-pipe heat exchanger in one piece.

* * * * *